US006670942B1

(12) United States Patent
Van Asma et al.

(10) Patent No.: US 6,670,942 B1
(45) Date of Patent: Dec. 30, 2003

(54) SAMPLER FOR A PICTURE DISPLAY DEVICE

(75) Inventors: Cornelis G. M. Van Asma, Eindhoven (NL); Matheus J. G. Lammers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/517,729

(22) Filed: Mar. 2, 2000

(30) Foreign Application Priority Data

Mar. 3, 1999 (EP) ..... 99200608

(51) Int. Cl.[7] ..... G09G 3/36
(52) U.S. Cl. ..... 345/99; 345/100; 345/546
(58) Field of Search ..... 345/100, 546

(56) References Cited

U.S. PATENT DOCUMENTS

| | | | | |
|---|---|---|---|---|
| 5,113,181 A | | 5/1992 | Inoue et al. | 340/783 |
| 5,557,302 A | * | 9/1996 | Levinthal et al. | 345/546 |
| 5,654,735 A | | 8/1997 | Nakajima | 345/99 |
| 5,757,351 A | * | 5/1998 | Lin et al. | 345/100 |
| 5,973,661 A | * | 10/1999 | Kobayashi et al. | 345/100 |

FOREIGN PATENT DOCUMENTS

EP 0760508 A1 3/1997

OTHER PUBLICATIONS

"Data Transfer Rate Reduction for Liquid Crystal Display Source Driver Integrated Circuit using Memory Block Addressing", IBM Technical Disclosure Bulletin, vol. 40. No. 8, Aug. 1997.

* cited by examiner

*Primary Examiner*—Steven Saras
*Assistant Examiner*—Uchendu O. Anyaso
(74) *Attorney, Agent, or Firm*—Laurie E. Gathman

(57) ABSTRACT

The invention relates to a sampler (2) and a method for converting a signal (S1) into a multiple signal (S220 . . . S222), comprising a stage (22) of sample & hold circuits (220 . . . 222). The sampler (2) comprises an input circuit (20) having means (201) for applying a signal (S1) in bursts (S20) to the stage (22). Successive bursts are separated by a time interval (Δt1, Δt2). In this way, an increased sample time of the signal (S222) in the last channel is provided for a display panel (3) or a subsequent sample & hold circuit. In general, use of the invention ensures that the number of stages in a sampler can be reduced. The resulting, more compact design is very suitable for integration because the power consumption can be kept low. The arrangement requires less buffering, which makes it simpler to avoid uniformity problems and ghost images. A signal input in bursts requires memories. By using memories that are already present in the display device for scaling and frame buffering (21), no additional memories are required.

20 Claims, 2 Drawing Sheets

SAMPLER FOR A PICTURE DISPLAY DEVICE

This application claims priority to European Patent Application No. 99200608.0 filed Oct. 29, 1999.

The invention relates to a method of converting a signal into a multiple signal, comprising the step of sampling and holding the signal in a plurality of sample & hold circuits of a stage.

The invention also relates to a sampler for converting a signal into a multiple signal, comprising an input circuit for receiving the signal, and at least one stage comprising a plurality of sample & hold circuits.

The invention further relates to a picture display device comprising a sampler as described above, and a picture display panel.

U.S. Pat. No. 5,654,735 describes a picture display device comprising such a sampler.

The patent describes a technique of driving a picture display panel in which a sampling method is used for driving a plurality of pixels simultaneously. Such a multipixel sampling method is particularly used in a liquid crystal display (LCD) with an active matrix. Such an LCD comprises pixel electrodes which are connected by means of switching elements to crossings of orthogonal data lines and scanning lines.

The sampler, corresponding to the video driver mentioned in said patent, delays the analog video signal for adapting the supply timing of the video signal to the picture display panel in conformity with the row intensity of the pixels. The video driver and the horizontal drive circuit of the picture display panel are driven by a timing circuit.

The video driver is illustrated as a first stage of three sample & hold (S&H) circuits and a second stage of another three S&H circuits. An S&H circuit of the first stage and an S&H circuit of the second stage connected thereto form part of a channel. Each channel is further provided with an amplifier. In this device, a video signal at the input is distributed across the three channels which thus jointly produce a threefold signal. The S&H circuits of the first stage are successively driven with separate signals so that each of them samples a successive part of the signal. This part is held and is available at the three outputs of the first stage which are connected to the three inputs of the second stage. The S&H circuits of the second stage are synchronously driven by a single signal. This means that they sample the signals, presented by the first stage, at the same instant. The parts of the signal are then simultaneously available at the output of this stage for a maximum period of three clock periods. The outputs of this stage are connected to three data lines of the picture display panel. The picture display panel is thus driven per block of three data lines and the clock frequency is reduced to one third.

The synchronous processing by the second stage must take place before the first S&H circuit of the first stage processes a successive part of the input signal. This means that the time for the second stage to sample the output signal of the last S&H circuit of the first stage, i.e. in the last channel, is short. Consequently, problems such as, for example, uniformity problems and ghost images, may occur when processing the signal.

It is an object of the invention to extend the sampling time of the signal.

To this end, the method according to the invention is characterized in that the signal is applied in the form of bursts to the stage, with successive bursts being separated by a time interval, A burst is a part of the signal which is transmitted at an increased clock frequency. After the last sample & hold circuit of the stage has sampled the signal, the signal is frozen during the time interval. After the time interval, the signal is sampled again by the first sample & hold circuit of the stage. The sampling time is extended by this method.

With this invention, an extra stage, which is added to prevent problems due to the short sampling time in the last channel, may be dispensed with in many cases.

As already mentioned the clock frequency of the signal must be increased, because the same information must be passed on (in the burst) within a shorter time.

In a first embodiment, the time interval is chosen to be approximately equal to the duration of a burst. This embodiment has the advantage that one stage yields approximately the same effect as two stages, as is known from said patent. The time interval is chosen, for example, to be such that the multiple signal satisfies the input specifications of a device connected to the output of the sampler.

A further embodiment provides a lower clock frequency than the first embodiment. This further embodiment is therefore characterized in that the time interval is chosen to be shorter than the duration of a burst. Here again, the stable time in the last channel after the first stage is extended and the risk of uniformity problems is reduced. In many cases, a subsequent stage will still be necessary to further extend the stable time. The time interval is chosen, for example, to be such that the multiple signal after the first stage can be satisfactorily sampled by the next stage. An extra stage, which would have been added to inhibit uniformity problems, can be dispensed with.

In a general embodiment, a sampler as described above is present in a picture display device comprising a picture display panel, wherein an output of the sampler is connected to the picture display panel. When used in such a picture display device, the invention ensures that the risk of uniformity problems and ghost images is reduced.

When using a burst input clock signal, a memory is required. For this purpose, the memory may be used which is generally already present in the picture display device for scaling and frame buffering.

According to the invention, the design of the sampler can be simplified so that a more compact design is possible at lower cost. A compact design is suitable for integration because the power consumption can be maintained small.

These and other aspects of the invention are apparent from and will be elucidated with reference to the embodiments described hereinafter.

Both FIGURES only show those elements which are necessary to understand the invention.

Figure 1:
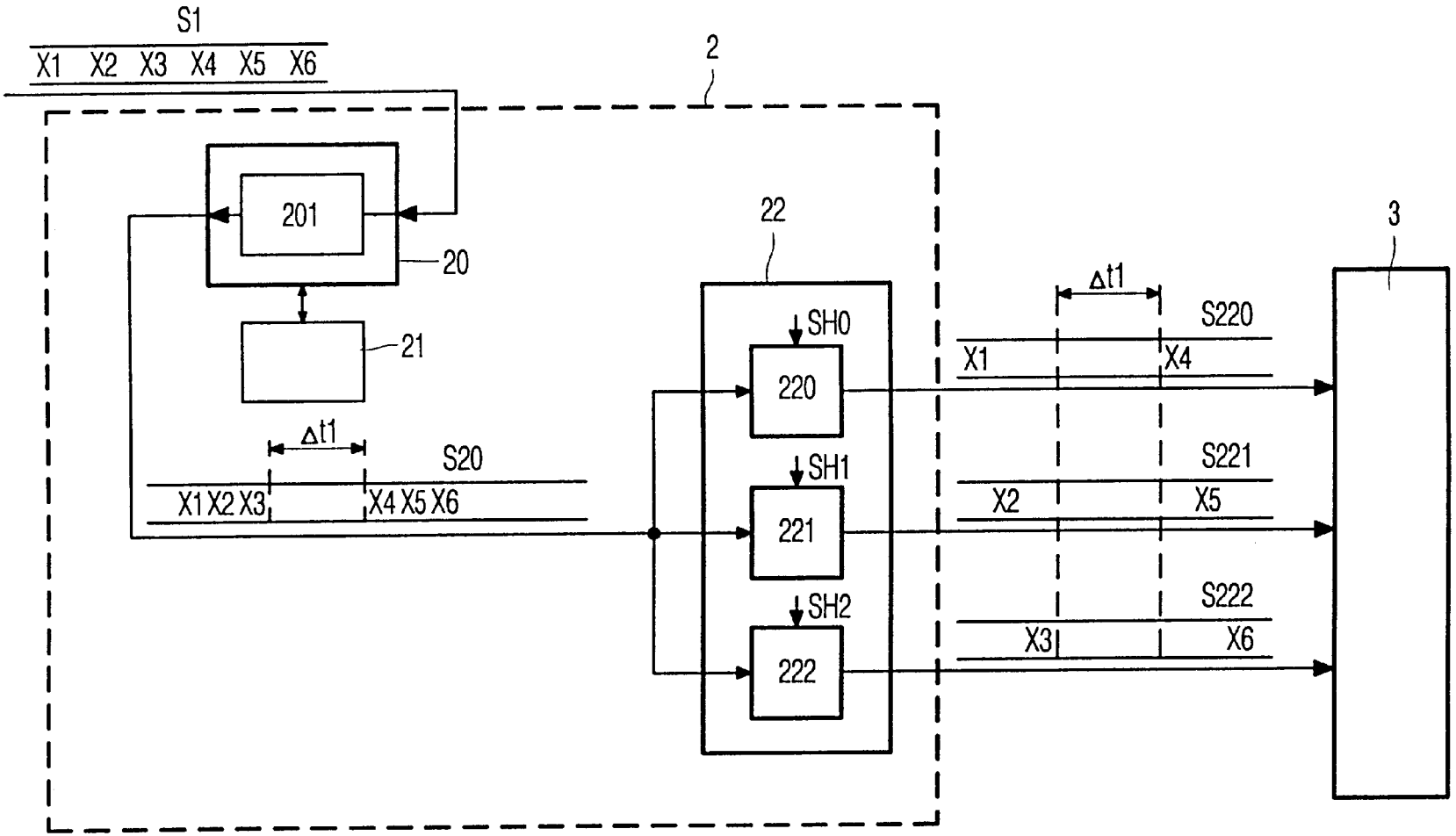
FIG. 1 shows an embodiment of a picture display device according to the invention.

FIG. 1 shows an embodiment of a picture display device 1 according to the invention. The picture display device 1 comprises a sampler 2 and a picture display panel 3. The sampler 2 comprises an input circuit 20, a memory 21 for scaling and frame buffering, and a stage 22. The stage 22 comprises three sample & hold circuits 220, 221 and 222. A number different from three is alternatively possible, which is also dependent on the number of inputs of the picture display panel 3.

A signal S1 is applied to the sampler 2. X1 . . . X6 denote samples. A sample is held stable at the output of a sample & hold circuit, until a subsequent sample is processed.

The signal S1 is received in the input circuit 20. The input circuit 20 comprises means 201 for applying the signal S1 in bursts to the stage 22, each burst being separated by a time interval Δt1. The output of the input circuit 20 is the signal S20. A burst generally comprises sufficient signals to cause all sample & hold circuits 220, 221 and 222 of the stage 22 to sample their part of the signal S20. In this case, in which a stage comprises three sample & hold circuits, this is three clock periods in the signal S20. The signal S20 alternately consists of three clock periods with information and a time interval Δt1 without information. The duration of this time interval Δt1 may be chosen to be equal to an integral number of clock periods for a simple implementation. A time interval which is unequal to an integral number of clock periods is alternatively possible, as well as a variable time interval.

The insertion of a time interval has the result that the clock frequency of the signal S20 applied in bursts must be higher than that of the original signal S1. This means that the clock period in the signal S20 is shorter than in the original signal S1.

The sample & hold circuits 210, 211 and 212 are driven by signals SH0, SH1 and SH2. The signals SH0 . . . SH2 successively activate the sample & hold circuits 220 . . . 222 so that each sample & hold circuit processes its part of a burst in the signal S20. The output of the sample & hold circuits 220, 221 and 222 is the multiple signal consisting of S220, S221 and S222. The time interval Δt1 becomes manifest in the period of time when the signal S222 is stable for further processing, i.e. until a new signal S220 becomes available at the output of the first sample & hold circuit 220. The further processing may take place, for example, in a subsequent stage, comprising sample & hold circuits, or directly in the picture display panel 3.

If the time interval Δt1 is sufficiently large for a correct processing by the picture display panel 3, a second stage is no longer necessary. This may occur, for example, when the time interval Δt1 is approximately as long as the time required for sampling the signal S20 once by all sample & hold circuits 220, 221 and 222 of the stage 22. This is shown in FIG. 1. Here, the time interval Δt1 is chosen, by way of example, to be equal to three clock periods of the signal S20. The clock frequency of the signal S20 should be doubled in this case, as compared with the clock frequency of the original S1 so as to pass on the same information per period of time.

Figure 2:
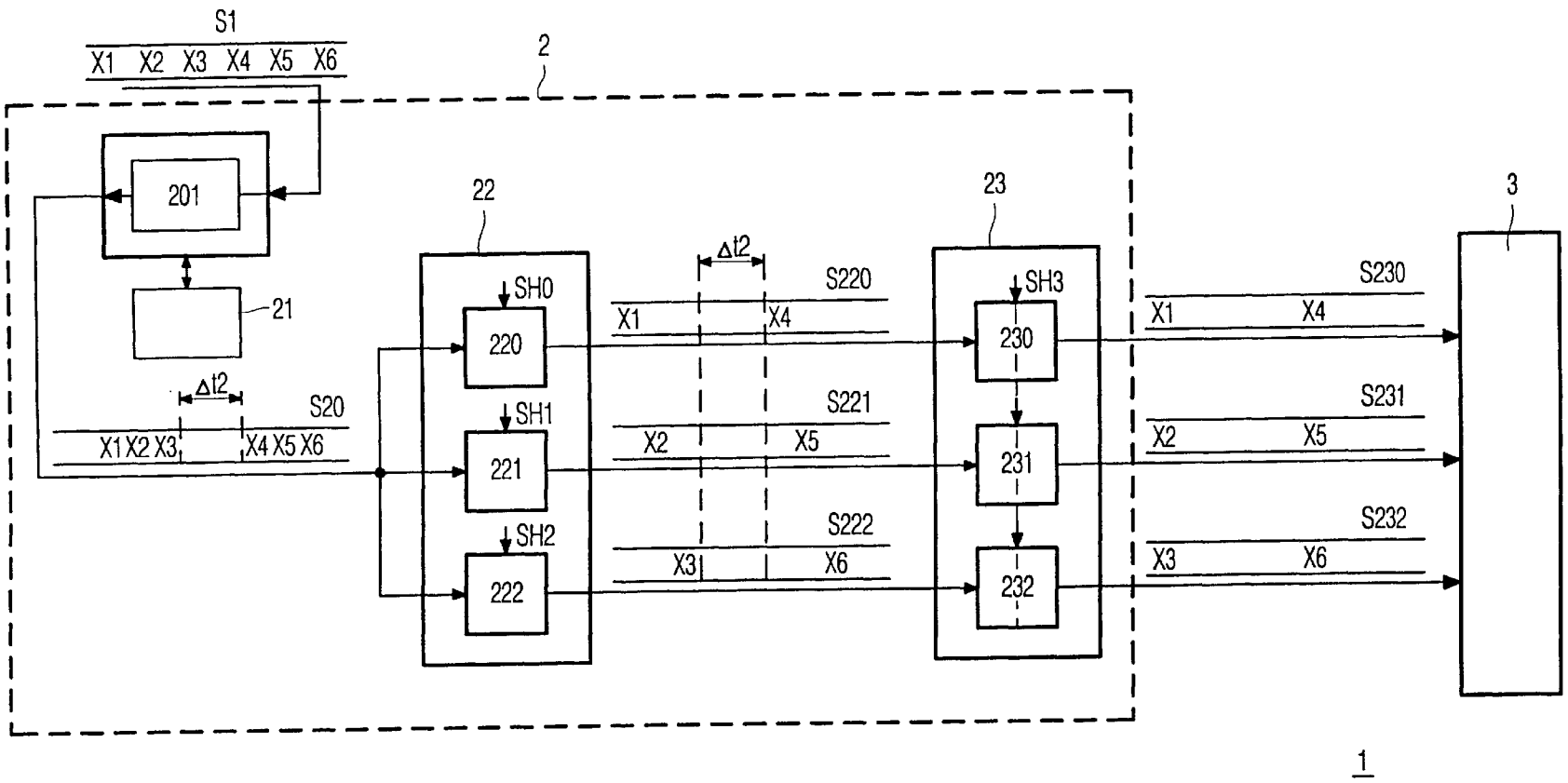
FIG. 2 shows an alternative embodiment of the picture display device according to the invention, in which the sampler comprises two stages.

In some cases, such an increase of the clock frequency could be objectionable in the design of the sampler 2. The first stage 22 must be able to process such a signal. To comply with this requirement, a shorter time interval Δt2 may be chosen, see FIG. 2. In FIG. 2, the stable time in the last channel after the first stage is also extended, but less than in FIG. 1.

Although in the embodiment of FIG. 1, a single stage may be sufficient, a subsequent stage may be required in many cases at a shorter time interval Δt2 so as to further extend the stable time of the signal S232. To this end, the sampler comprises a stage 23 which, likewise as the stage 22, comprises three sample & hold circuits, namely 230, 231, 232. The sample & hold circuits 230 . . . 232 are driven, for example, simultaneously by a signal SH3. This means that the signals S220 . . . S222 are simultaneously sampled and that the result is simultaneously available at the outputs of the sample & hold circuits 230, 231 and 232 as the signals S230, S231 and S232. The advantage of this embodiment is that the sampling time of S222 for stage 23 has increased as compared with a sampler in which signal S20 is not applied in bursts, but that the clock frequency for the signal S20 does not need to be increased to such an extent as in the embodiment described with reference to FIG. 1. The signals S230 . . . S232 are stable for a maximum period of time, namely the time of three clock periods of the original signal S1.

An extra stage, which would have been added to inhibit uniformity problems and ghost images if there were no time interval Δt2, may be dispensed with. In this way, a two-stage sampler will be possible in those cases where, without the invention, a three-stage sampler is necessary.

Although other configurations are feasible, it will generally be possible to economize on one stage in a sampler according to the invention. The design thus becomes simpler. The bandwidth can be increased and the risk of different amplifications in the different channels is reduced. The compact design is suitable for integration because the power consumption can be maintained low.

When using a burst input clock signal, a memory is required to store a part of the signal S1. For this purpose, use may be made of the memory 21 for scaling and frame buffering, which memory is present in the picture display device 1. The memory 21 must minimally be able to store the signal of a burst. For the examples described, this is the signal S1 during three clock periods. Due to this measure, it is not necessary to arrange extra memories in the picture display device 1.

Instead of sample & hold circuits, for example, track & hold circuits may be used alternatively.

It is possible to achieve the same effects in accordance with the same principle but with a different configuration than the devices described. It is possible, for example, to process a digital signal in the sampler or in a previous stage in such a way that the same effect is achieved as when processing an analog signal, which analog signal originates or does not originate from a D/A converter.

It should be noted that the above-mentioned embodiment illustrates rather than limits the invention. Those skilled in the art will be able to conceive alternative embodiments without departing from the scope of the appended claims.

Reference symbols between parentheses in the claims are included to elucidate the claims and should not be construed as limiting the claim.

The word "comprising" and its derivatives do not exclude the existence of elements or steps other than those mentioned in a claim. The invention may be implemented by means of separate elements and by a correctly programmed computer.

In the claims relating to the sampler or the picture display device, in which various means are mentioned, several of these means may be implemented in one and the same piece of hardware.

What is claimed is:

1. A method of converting a signal (S1) into a multiple signal (S220 . . . S222), comprising the step of sampling and holding the signal (S1) in a plurality of sample & hold circuits (220 . . . 222) of a stage (22), wherein the signal (S1) is applied in the form of bursts (S20) to the stage (22), with successive bursts being separated by a time interval (Δt1, Δt2).

2. A method as claimed in claim 1, wherein the time interval (Δt1) is chosen to be approximately equal to the duration of a burst.

3. A method as claimed in claim 1, wherein the time interval (Δt2) is chosen to be shorter than the duration of a burst.

4. A sampler (2) for converting a signal (S1) into a multiple signal (S220 . . . S222), comprising an input circuit (2) for receiving the signal (S1), and at least one stage (22) comprising a plurality of sample & hold circuits (220 . . . 222), wherein the input circuit (20) comprises means (201) for applying the signal (S1) in the form of bursts (S20) to the stage (22), with successive bursts being separated by a time interval (Δt1, Δt2).

5. A sampler (2) as claimed in claim 4, wherein the time interval (Δt1 ) is chosen to be approximately equal to the duration of a burst.

6. A sampler (2) as claimed in claim 4, wherein the time interval (Δt2) is chosen to be shorter than the duration of a burst.

7. A picture display device (1) comprising a sampler (2) as claimed in claim 4, and a picture display panel (3), wherein an output of the sampler (2) is connected to the picture display panel (3).

8. A picture display device (1) as claimed in claim 7, wherein the picture display device 91) comprises memories (21) for scaling and frame buffering, the memories (21) being also adapted to store the signal (S1) during the time interval (Δt1, Δt2).

9. A system for converting a signal into a multiple signal, comprising:

an input circuit receiving the signal including a series of sequential samples and generating the multiple signal including bursts of sequential samples corresponding to samples within the series, sequential bursts each separated by a time interval.

10. The system according to claim 9, wherein the samples within the bursts have a shorter duration than samples within the series.

11. The system according to claim 9, further comprising:

a memory coupled to the input circuit for scaling and frame buffering.

12. The system according to claim 11, further comprising:

a sampling stage coupled to the input circuit and receiving the bursts separated by the intervals.

13. The system according to claim 12, wherein the sampling stage further comprises:

a plurality of sample and hold circuits each acquiring a sample during a different sample period during each burst and holding the acquired sample at an output until a corresponding sample period during a subsequent burst.

14. The system according to claim 13, further comprising:

a picture display device having inputs coupled to the outputs of the sample and hold circuits.

15. The system according to claim 13, wherein the number of sample and hold circuits equals a number of samples within each burst.

16. The system according to claim 12, wherein the sampling stage operates with a clock period shorter than a duration of samples within the series.

17. The system according to claim 16, wherein the clock period for the sampling stage is approximately twice the duration of samples within the series.

18. The system according to claim 12, wherein outputs of the sampling stage are coupled to an input of a second sampling stage, the sampling stage holding samples at outputs thereof for staggered periods and the second sampling stage holding samples at outputs thereof for concurrent periods.

19. The system according to claim 9, wherein the time interval is approximately equal to a duration of each burst.

20. The system according to claim 9, wherein the time interval is shorter than a duration of each burst.

* * * * *